United States Patent [19]

Koike et al.

[11] Patent Number: 4,768,486

[45] Date of Patent: Sep. 6, 1988

[54] FUEL SUPPLY CONTROL SYSTEM FOR INTERNAL COMBUSTION ENGINE

[75] Inventors: Yuzuru Koike; Kiyoshi Tsukimura, both of Wako, Japan

[73] Assignee: Honda Giken Kogyo Kabushiki Kaisha, Tokyo, Japan

[21] Appl. No.: 127,187

[22] Filed: Dec. 1, 1987

[30] Foreign Application Priority Data

Dec. 5, 1986 [JP] Japan ..... 61-291307

[51] Int. Cl.[4] ..... F02M 39/00

[52] U.S. Cl. ..... 123/442; 123/478; 123/445

[58] Field of Search ..... 123/442, 445, 478

[56] References Cited

U.S. PATENT DOCUMENTS 2,724,376 11/1955 Baumbeckel ..... 123/442
4,276,862 7/1981 Matsumoto ..... 123/442
4,378,000 3/1983 Moriya et al. ..... 123/442
4,462,367 7/1984 Tanabe et al. ..... 123/442

*Primary Examiner*—Raymond A. Nelli
*Attorney, Agent, or Firm*—Lyon & Lyon

[57] ABSTRACT

A fuel supply control system for an internal combustion engine having a fuel injection valve arranged within a suction passage at a location upstream of an intake manifold and a throttle valve therein, and an air throttle valve arranged within the suction passage at a location upstream of the throttle valve and having a throttle opening disposed to be positioned opposite the nozzle of the fuel injection valve when the air throttle valve is fully closed whereby intake air flows through the throttle opening in the vicinity of the nozzle of the fuel injection valve at an increased speed. The system controls a quantity of fuel supplied to a plurality of cylinders of the engine in accordance with operating conditions of the engine. Further, the system increases the quantity of fuel when the air throttle valve is opened.

5 Claims, 3 Drawing Sheets

FUEL SUPPLY CONTROL SYSTEM FOR INTERNAL COMBUSTION ENGINE

BACKGROUND OF THE INVENTION

1. Field of the Invention

The present invention relates to a fuel supply control system for internal combustion engines and, more particularly, the present invention relates to a fuel supply control system for a multicylinder internal combustion engine having a fuel injection valve for commonly supplying fuel to a group of cylinders of the engine.

2. Description of the Prior Art

There has been proposed a multicylinder internal combustion engine having a fuel injection valve provided upstream of the throttle valve provided within the suction pipe upstream of the intake manifold thereof for commonly supplying fuel to a group of cylinders thereof. Such a multicylinder internal combustion engine requires a less number of fuel injection valves than one equipped with a plurality of fuel injection valves with one for each of the cylinders thereof, thereby reducing the cost of the engine effectively. However, when a fuel injection valve is provided for a plurality of cylinders, it is necessary to control fuel supply operation so that fuel is distributed uniformly to all the cylinders by sufficiently atomizing fuel before the fuel flows into the intake manifold.

To this end, an internal combustion engine has been proposed, which is provided with an air throttle valve having a valve element provided at a peripheral edge thereof with a notched opening which serves as a throttle opening, and disposed so that the notched opening is positioned opposite the nozzle of a fuel injection valve provided upstream of a throttle valve with respect to the direction of flow of intake air when the valve element is shut. The engine is also provided with a Venturi tube, which is similar to that of a carburetor, disposed between the throttle valve and the fuel injection valve to regulate the degree of opening of the air throttle valve according to the negative pressure prevailing within the Venturi tube. The air throttle valve opens when the nagative pressure increases as the flow speed of air flowing through the Venturi tube increases, and shuts when the negative pressure decreases as the flow speed of air flowing through the Venturi tube decreases. Thus, the flow speed of intake air in the vicinity of the nozzle of the fuel injection valve is increased by the air throttle valve to atomize fuel satisfactorily during the low-load low-speed operation of the engine.

In such a proposed internal combustion engine, however, the flow speed of intake air drops immediately after the air throttle valve has been opened to deteriorate the atomization of fuel. Consequently, the amount of fuel that wets the throttle valve and the associated parts increases reducing the actual amount of fuel supplied to the cylinders. Furthermore, the intake air supply rate increases sharply when the air throttle valve opens, and thereby the air-fuel ratio increases temporarily, so that a lean air-fuel mixture is supplied to the cylinders.

SUMMARY OF THE INVENTION

It is therefore an object of the invention to provide a fuel supply control system for internal combustion engines, which is capable of controlling the fuel supply system of an internal combustion engine so that the air-fuel ratio will not be increased excessively to reduce the output of the engine and to adversely affect the exhaust emission characteristics even immediately after the air throttle valve has been opened.

To attain the above object, the present invention provides a fuel supply control system for an internal combustion engine having a plurality of cylinders, a suction passage having an intake manifold connected to the cylinders, a throttle valve arranged within the suction passage at a location upstream of the intake manifold, a fuel injection valve arranged within the suction passage at a location upstream of the throttle valve and having a nozzle, and an air throttle valve arranged within the suction passage at a location upstream of the throttle valve and having a throttle opening disposed to be positioned opposite the nozzle of the fuel injection valve when the air throttle valve is fully closed whereby intake air flows through the throttle opening in the vicinity of the nozzle of the fuel injection valve at an increased speed, the system comprising fuel supply control means for controlling a quantity of fuel supplied to the cylinders in accordance with operating conditions of the engine.

The fuel supply control system is characterized by an improvement comprising fuel increasing means for increasing the quantity of fuel supplied to the cylinders when the air throttle valve is opened.

Preferably, the system includes inhibiting means for disabling the fuel increasing means to thereby inhibit the increasing of the quantity of fuel, when the throttle valve assumes a degree of opening smaller than a predetermined value.

Also preferably, the fuel increasing means increases the quantity of fuel by an increment dependent upon fuel injection rate characteristics of said fuel injection valve and a temperature of the engine.

In a preferred embodiment of the invention, the fuel increasing means executes the increasing of the quantity of fuel at a predetermined time interval asynchronous with crankshaft angle position of the engine.

The above and other objects, features and advantages of the invention will become apparent from the following description taken in conjunction with the accompanying dawings:

DETAILED DESCRIPTION

The invention will now be described in detail with reference to the drawings showing an embodiment thereof.

Figure 1:
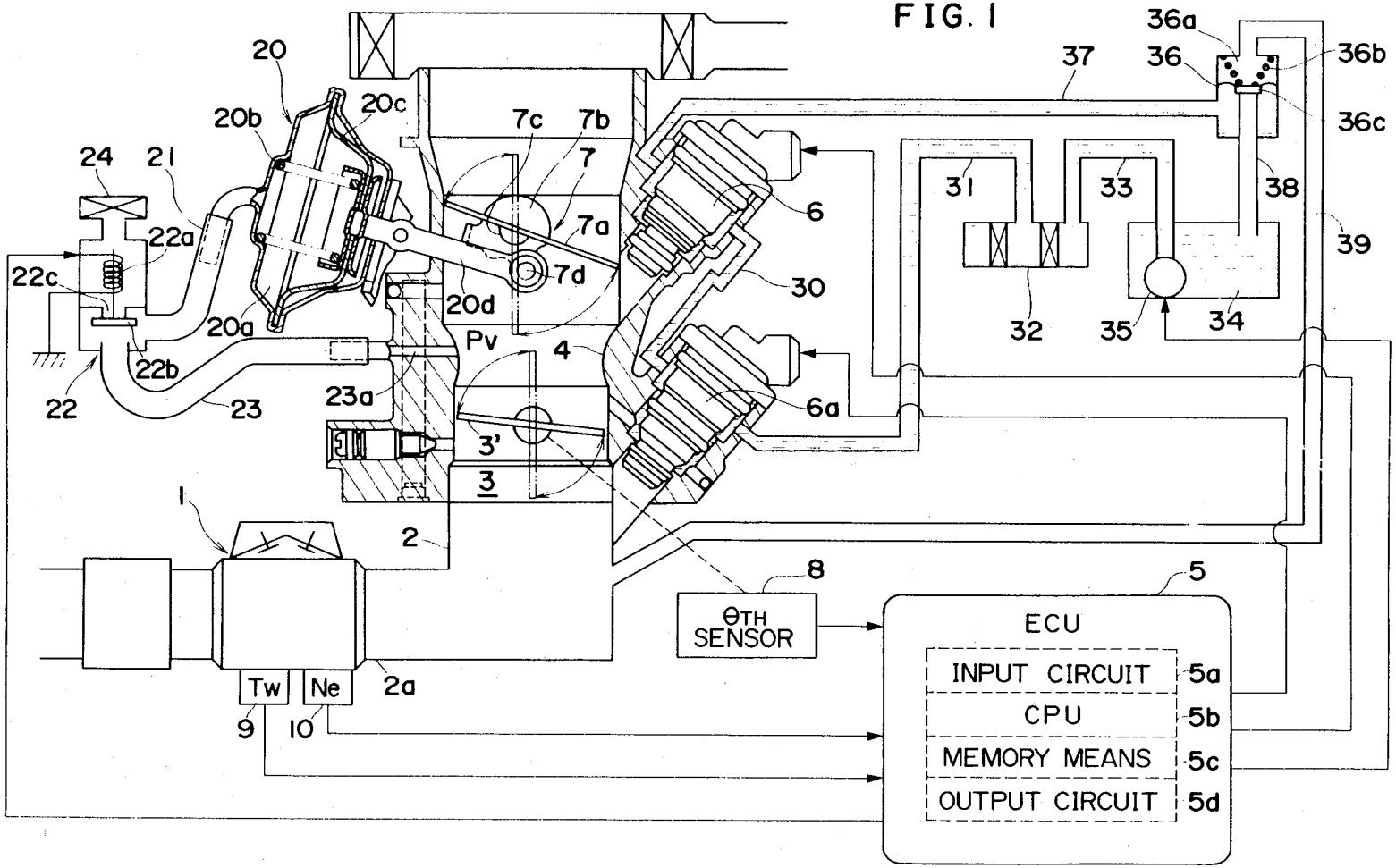
FIG. 1 is a schematic illustration showing the general construction of an internal combustion engine and a fuel supply control system for same, according to the invention.

Referring to FIG. 1, a suction pipe 2 is connected through an intake manifold 2*a* thereof to an internal combustion engine 1, for example, a four-cylinder four-cycle internal combustion engine. The suction pipe 2 is provided with a throttle body 3 internally provided with a throttle valve 3' upstream of the intake manifold 2a. A throttle valve angle sensor (hereinafter referred to "the $\theta_{TH}$ sensor") 4 for detecting the throttle valve angle, namely, the degree of opening, of the throttle valve 3' is associated with the throttle valve 3' to give an electric signal representing the degree of opening of the throttle valve 3' to an electronic control unit (hereinafter abbreviated to "the ECU") 5.

Figure 2:
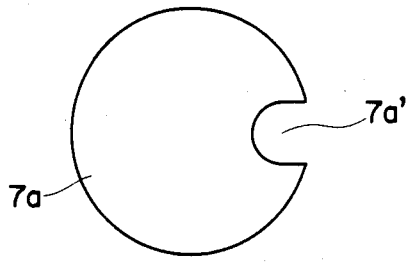
FIG. 2 is a plan view of an air throttle valve 7 shown in FIG. 1.

A fuel injection valve 6 and an air throttle valve 7 are provided in the suction pipe 2 at a location slightly upstream of the throttle valve 3'. The fuel injection valve 6 supplies fuel to all the cylinders of the engine 1 while the engine 1 is operating in an operating mode other than an idling mode. The air throttle valve 7 regulates the flow speed of intake air in the vicinity of the nozzle of the fuel injection valve 6 within the suction pipe 2. As shown in FIG. 2, the valve element 7a of the air throttle valve 7 is in the form of a disk provided at a peripheral edge thereof with a notched opening 7a' serving as a throttle opening. When the valve element 7a is closed as indicated by the solid lines in FIG. 1, the area of the air flow passage upstream of the throttle valve 3' within the throttle body 3 is reduced to a minimum area corresponding to the area of the notched opening 7a', and the notched opening 7a is positioned opposite the nozzle of the fuel injection valve 6.

The air throttle valve 7 is a pneumatic valve incorporating a diaphragm actuator 20. The negative pressure chamber 20a of the diaphragm actuator 20 is communicated with a port 23a opening into a Venturi section 4 formed in the throttle body 3 upstream of the throttle valve 3', by means of a tube 21, a pressure changeover valve 22 and a tube 23. A diaphragm 20c defining the negative pressure chamber 20a is biased by a spring 20b. A rod 20d has one end pivotally joined to the valve holder 7b of the air throttle valve 7 with a pin 7d and the other end connected to the diaphragm 20c. The valve holder 7b is pivotally mounted on a fixed shaft 7c. The valve element 7a is fixed to the valve holder 7b for pivotal motion together with the latter. As the negative pressure Pv in the Venturi section 4 increases, the diaphragm moves against the resilient force of the spring 20b to turn the valve element 7a of the air throttle valve 7 clockwise as viewed in FIG. 1 toward a position indicated by the two-dot chain lines in FIG. 1 through the rod 20d and the valve holding member 7b. Thus, the valve element 7a of the air throttle valve 7 approaches the closed position (the position indicated by the solid lines in FIG. 1) as the negative pressure Pv decreases, and approaches the open position (a position indicated by the two-dot chain lines in FIG. 1) as the negative pressure Pv increases.

The pressure changeover valve 22 has a solenoid 22a, and a valve element 22b which closes an opening 22c when the solenoid 22a is de-energized and closes an open end of the tube 23 when the solenoid 22a is energized. Accordingly, when the solenoid 22a is deenergized, the negative pressure chamber 20a communicates with the Venturi section 4 through the open end of the tube 23 and, when the solenoid 22a is energized, the open end of the tube 23 is closed and the opening 22c is opened to allow the negative pressure chamber 20a to communicate through a filter 24 with the atmosphere, and thereby the valve element 7a of the air throttle valve 7 is held at the closed position irrespective of the magnitude of the negative pressure Pv in the Venturi section 4.

An auxiliary fuel injection valve 6a is provided in the suction pipe. 2 at a location downstream of the throttle valve 3' and upstream of the intake manifold 2a. The auxiliary fuel injection valve 6a supplies fuel to all the cylinders while the sufficiently warmed up engine 1 is idling. The auxiliary fuel injection valve 6a is connected through a tube 31, a strainer 32 and a tube 33 to a fuel tank 34. The fuel injection valve 6 and the auxiliary fuel injection valve 6a are interconnected by a tube 30. A fuel pump 35 supplies fuel under pressure through the tubes 31, 30 and the strainer 32 to the fuel injection valve 6 and the auxiliary fuel injection valve 6a. The fuel injection valve 6 is connected through return tubes 37 and 38 to the fuel tank 34. A pressure regulator 36 is interposed between the return tubes 37 and 38. The negative pressure chamber 36a of the pressure regulator 36 communicates with the suction pipe 2 at a location downstream of the throttle valve 3' by means of a tube 39. The valve element 36c of the pressure regulator 36 is biased toward the valve seat by a spring 36b. Accordingly, the position of the valve element 36c of the pressure regulator 36 is dependent on the balance of the resilient force of the spring 36b and the negative pressure prevailing within the suction pipe 2 downstream of the throttle valve 3'. Thus, the fuel pressure within the tubes 30 and 31 is regulated by the pressure regulator 36 at a pressure higher by a fixed amount than the pressure at a position within the suction pipe 2 downstream of the throttle valve 3'.

A temperature sensor (hereinafter referred to as "the TW sensor") 9 for detecting the temperature of the cooling water is provided in the cylinder block of the engine 1. The TW sensor 9 comprises a thermistor or the like disposed within the water jacket filled with the cooling water, of the cylinder block of the engine 1. The TW sensor 9 gives a temperature signal representing the temperature of the cooling water to the ECU 5. An engine speed sensor (hereinafter referred to as "the Ne sensor") 10 is provided in facing relation to the camshaft, not shown, or the crankshaft, not shown, of the engine 1. The Ne sensor 10 gives, whenever the crankshaft rotates through an angle of 180°, a crank angle signal (hereinafter referred to as "the TDC signal") representing a predetermined crank angle before a top dead center TDC of the piston of each cylinder, at which the suction stroke of the piston of the cylinder is started, to the ECU 5.

The ECU 5 comprses an input circuit 5a which shapes the respective waveforms of input signals received from some of the sensors, adjusts the respective voltages of input signals from other sensors to a predetermined level and converts the respective analog values of the voltage-adjusted input signals to corresponding digital values, a central processing unit (hereinafter abbreviated to "the CPU") 5b, a memory means 5C which stores programs to be executed by the CPU 5b and results of operations executed by the CPU 5b, and an output circuit 5d which gives driving signals to the pressure changeover valve 22, the fuel injection valve 6 and the auxiliary fuel injection valve 6a.

Figure 3:
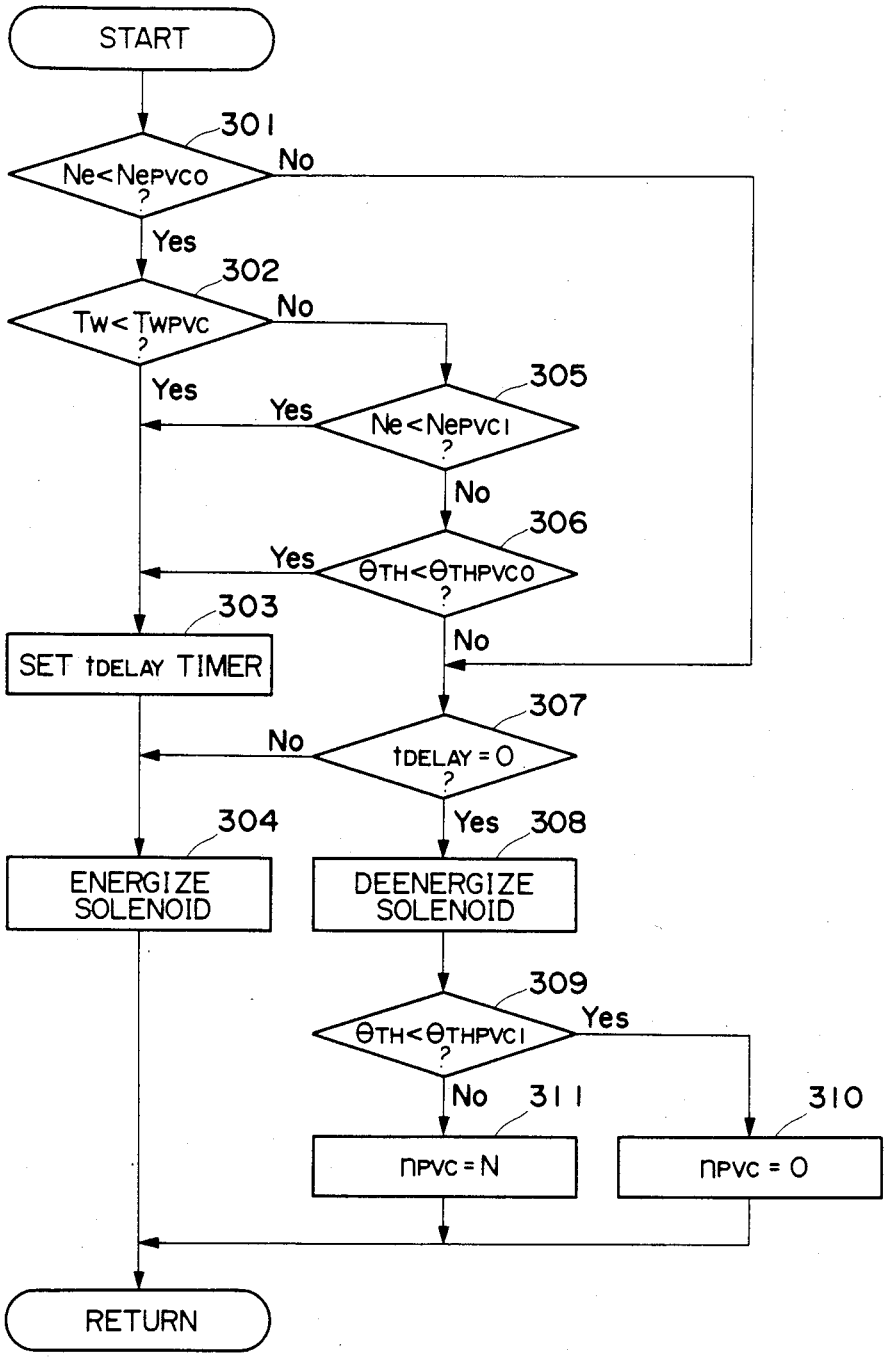
FIG. 3 is a flow chart of an air throttle valve control program according to the invention.

The CPU 5b executes a pressure changeover control program shown in FIG. 3 for controlling the pressure changeover valve 22, and a fuel supply control program, not shown, which is executed upon every reception of the TDC signal. The CPU 5b energizes or deenergizes the solenoid 22a of the pressure changeover valve 22 in response to engine operating parameter signals applied by the sensors to the input circuit 5a and calculates fuel injection periods respectively for the fuel injection valve 6 and the auxiliary fuel injection valve 6a, according to the control programs.

The CPU 5b serves as fuel supply control means and calculates a fuel injection period $T_{OUT}$ for the fuel injection valve 6 according to the fuel supply control program upon every reception of the TDC signal by using the following expression:

$$T_{OUT}=Ti\times K_{TW}\times K_1+K_2 \quad (1)$$

where Ti is a basic fuel injection period dependent on the engine speed Ne and the absolute pressure $P_{BA}$ within the suction pipe 2, $K_{TW}$ is a temperature-dependent correction coefficient dependent on the temperature TW of the engine cooling water, and $K_1$ and $K_2$ are correction coefficients and correction values constants, respectively, dependent on engine operating parameter signals.

The CPU 5b serves as fuel increasing means and calculates a fuel injection period $T_{MA}$ for the fuel injection valve 6 asynchronously with the TDC signal to increase the fuel supply quantity in accelerating the engine, by using the following expression:

$$T_{MA}=T_{OUTA0}+T_{OUTA1}+T_{VM} \quad (2)$$

where $T_{OUTA0}$ is a basic acceleration increment dependent on the opening speed of the throttle valve, $T_{OUTA1}$ is an acceleration increment dependent on the movement of the valve element 7a of the throttle valve 7 from the closed position to the open position, and $T_{VM}$ is a correction value dependent on the condition of the battery.

During the low-load operation of the engine 1, the CPU 5b controls the fuel supply system so as to supply fuel by the auxiliary fuel injection valve 6a provided downstream of the throttle valve. The description of the manner of this control operation of the CPU 5b is omitted.

The ECU 5 executes the control program shown in FIG. 3 for controlling the pressure changeover valve 22 which controls the air throttle valve 7, upon every reception of the TDC signal.

In step 301, a decision is made as to whether the engine speed Ne is lower than a predetermined engine speed $N_{epvc0}$ (for example, 2000 rpm), and a decision is made in step 302 as to whether the temperature TW of the engine cooling water is lower than a predetermined temperature $T_{wpvc}$ (for example, 60° C.). When both the decisions rendered in steps 301 and 302 are "Yes", namely, when the engine 1 has not sufficiently warmed up and is operating at a low engine speed, fuel injected into the suction pipe will not be atomized satisfactorily. Therefore, a timer $t_{DELAY}$, which is used in step 307, is set for a predetermined time $t_{DELAY}$ (for example, 0.3 sec) in step 303, the solenoid 22a of the pressure changeover valve 22 is energized in step 304 to cause the air throttle valve 7 to be closed, and then the control program is ended.

When the decision rendered in step 301 is "No", the routine jumps to step 307, where a decision is made as to whether the predetermined time $t_{DELAY}$ for which the timer $t_{DELAY}$ has been set has passed. When the decision rendered in step 307 is "No", the routine returns to step 304 to hold the air throttle valve 7 closed, and then the routine is ended. On the contrary, when the decision rendered in step 307 is "Yes", the routine advances to step 308.

Thus, the air throttle valve 7 is opened with a delay, namely, the time $t_{DELAY}$, to reduce shocks attributable to the sharp variation of the flow rate of the intake air by holding the air throttle valve 7 closed without opening the air throttle valve 7 upon the arrival of the condition of the engine 1 at a condition for opening the air throttle valve 7 and, particularly in accelerating the engine 1, opening the air throttle valve 7 only after the flow rate of the intake air has increased to a high level so that the flow rate of the intake air changes at a low rate.

When the decision rendered in step 302 is "No", a decision is made in step 305 as to whether the engine speed Ne is lower than a predetermined engine speed $N_{epvcl}$ (for example, 1200 rpm) and a decision is made in step 306 as to whether the throttle angle $\theta_{TH}$ is smaller than a predetermined throttle angle $\theta_{THPVCO}$. When the flow speed of the intake air through the Venturi section 4 is low, the decision rendered in step 305 or 306 is "Yes". Then, the timer $t_{DELAY}$ is set in step 303, the solenoid 22a is energized in step 304 to hold the air throttle valve 7 closed, and then the control program is ended. When both the decisions rendered in steps 305 and 306 are "No", step 307 is executed to decide whether the predetermined time $t_{DELAY}$ timed by the timer $t_{DELAY}$ has elapsed. When the decision rendered in step 307 is "No", step 304 is executed, and then the control program is ended.

Figure 4:
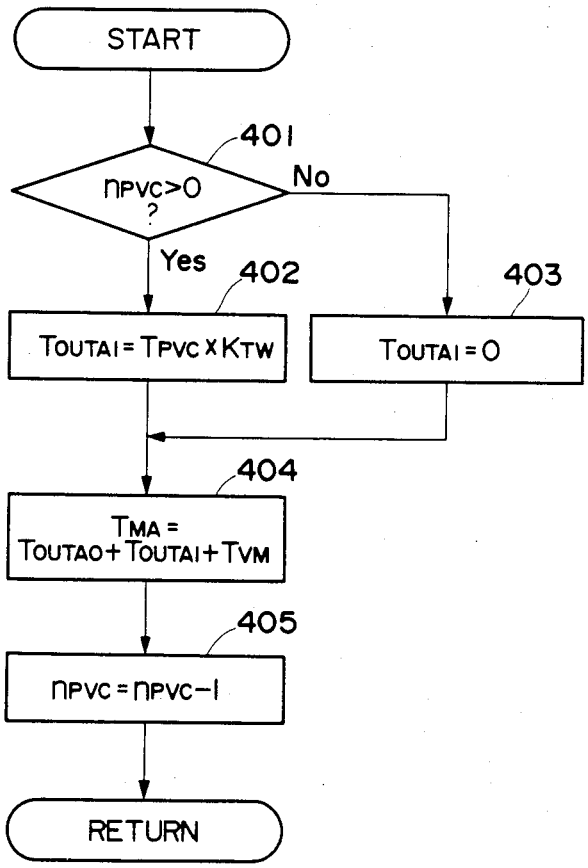
FIG. 4 is a flow chart of an asynchronous fuel supply quantity increasing operation control program according to the invention.

When the decision rendered in step 307 is "Yes", step 308 is executed to deenergize the solenoid 22a to render the operation of the air throttle valve 7 to direct control by the negative pressure Pv prevailing within the Venturi section 4, and then step 309 is executed to decide whether the throttle angle $\theta_{TH}$ is smaller than a predetermined angle $\theta_{THPVC1}$ (for example 10°) When the decision rendered in step 309 is "Yes", a flag $n_{PVC}$ indicating the number of cycles of asynchronous fuel supply quantity increasing operation, which is to be used in step 401 of the control program shown in FIG. 4, hereinafter described, is set to "0" in step 310 and, when "No", the flag $n_{PVC}$ is set to a predetermined initial value N (for example, 3) in step 311, and the control program is ended. Thus, the CPU 5b and the steps 309 and 310 constitute inhibiting means for inhibiting the increase of the fuel supply quantity at the moment of opening of the air throttle valve 7, hereinafter described. When the flag $n_{PVC}$ is set to the predetermined value N, the asynchronous fuel supply quantity increasing operation is repeated N times, as described later. However, when the degree of opening of the throttle valve 3' represented by the throttle angle $\theta_{TH}$ is smaller than $\theta_{THPVC1}$, the asynchronous fuel supply quantity increasing operation is not necessary because the degree of reduction of the richness of the mixture is insignificant even if the air throttle valve 7 is opened to such a small degree. Accordingly, in such a case, the flag $n_{PVC}$ is set to "0" in step 310.

FIG. 4 shows an asynchronous fuel supply quantity increasing operation control program executed by the fuel supply control system according to the invention for increasing the fuel supply quantity of the fuel injection valve 6 asynchronously with the TDC signal in accelerating the engine 1. This control program is repeated at a predetermined time interval $\tau$ (for example, 10 msec) under the timing operation of a timer.

In step 401, a decision is made as to whether the flag $n_{PVC}$ indicating the number of cycles of the asynchronous fuel supply quantity increasing operation to be executed is greater than "0". When the decision rendered in step 401 is "Yes", an accelerating fuel increment applied at the moment of opening of the air throttle valve 7 is calculated in step 402 by using the following expression:

$$T_{OUTA1} = T_{pvc} \times K_{TW} \quad (3)$$

where $T_{pvc}$ is a constant dependent on the fuel injection rate characteristics of the fuel injection valve 6, and $K_{TW}$ is a temperature-dependent correction coefficient dependent on the temperature TW of the engine cooling water, which is the same as the temperature-dependent correction coefficient TW in the expression (1).

When the decision rendered in step 401 is "No", the fuel increment $T_{OUTA1}$ at the moment of opening of the air throttle valve 7 is set to "0" in step 403.

After step 402 or 403 has been executed, the fuel injection period $T_{MA}$ for the fuel injection valve 6 is calculated by substitutin $T_{OUTA1}$ in the expression (2) in step 404, "1" is subtracted from the flag $n_{pvc}$ in step 405, and then the control program is ended.

Thus, according to the present invention, when the air throttle valve 7 is opened while the throttle valve 3' is opened by an angle greater than the predetermined throttle angle $\theta_{THPVC1}$, the asynchronous fuel injection period $T_{MA}$ is increased by an increment of $T_{OUTA1}$ over N cycles of asynchronous fuel supply quantity increasing operation after the air throttle valve 7 has been opened, and thereby an excessive increase in the air-fuel ratio of the mixture immediately after the air throttle valve has been opened is obviated, and hence deterioration of the output characteristics of the engine and that of the exhaust emission characteristics thereof are prevented.

Although the invention has been described in its preferred form with a certain degree of particularity, obviously many changes and variations in the invention are possible. It is therefore to be understood that the present invention is not limited to the specific embodiment described herein and may be practied otherwise than specifically described herein without departing from the scope and spirit thereof.

What is claimed is:

1. In a fuel supply control system for an internal combustion engine having a plurality of cylinders, a suction passage having an intake manifold connected to said cylinders, a throttle valve arranged within said suction passage at a location upstream of said intake manifold, a fuel injection valve arranged within said suction passage at a location upstream of said throttle valve and having a nozzle, and an air throttle valve arranged within said suction passage at a location upstream of said throttle valve and having a throttle opening disposed to be positioned opposite said nozzle of said fuel injection valve when said air throttle valve is fully closed whereby intake air flows through said throttle opening in the vicinity of said nozzle of said fuel injection valve at an increased speed, said system comprising fuel supply control means for controlling a quantity of fuel supplied to said cylinders in accordance with operating conditions of said engine, the improvement comprising fuel increasing means for increasing the quantity of fuel supplied to said cylinders when said air throttle valve is opened.

2. A fuel supply control system as claimed in claim 1, including inhibiting means for disabling said fuel increasing means to thereby inhibit the increasing of the quantity of fuel, when said throttle valve assumes a degree of opening smaller than a predetermined value.

3. A fuel supply control system as claimed in claim 1, wherein said fuel increasing means increases the quantity of fuel by an increment dependent upon fuel injection rate characteristics of said fuel injection valve and a temperature of said internal combustion engine.

4. A fuel supply control system as claimed in claim 1, wherein said fuel increasing means executes the increasing of the quantity of fuel at a predetermined time interval asynchronous with crankshaft angle position of said engine.

5. A fuel supply control system as claimed in claim 4, wherein said fuel increasing means executes the increasing of the quantity of fuel a predetermined number of times after said air throttle valve has been opened.

* * * * *